US005915434A

United States Patent [19]

Juarez

[11] Patent Number: 5,915,434

[45] Date of Patent: Jun. 29, 1999

[54] HAND-HELD BODY WASHING AND SCRUBBING DEVICE

[76] Inventor: Mark Reinle Juarez, 2141 W. 133rd Ave., San Leandro, Calif. 94577

[21] Appl. No.: 08/883,466

[22] Filed: Jun. 26, 1997

[51] Int. Cl.[6] ..... A47K 7/02

[52] U.S. Cl. ..... 15/114; 15/118; 15/209.1; 15/244.3; 601/138; D28/63; D32/43

[58] Field of Search ..... 15/104.93, 104.94, 15/114, 118, 208, 209.1, 210.1, 222, 229.11, 229.14, 244.1, 244.3, 244.4; 401/201; 601/131, 134–138; D28/63; D32/43

[56] References Cited

U.S. PATENT DOCUMENTS

| | | | |
|---|---|---|---|
| D. 295,995 | 5/1988 | Ryland | D21/608 |
| 1,206,463 | 11/1916 | Parkinson | 601/135 X |
| 2,152,697 | 4/1939 | Kingman | 15/244.3 X |
| 2,269,871 | 1/1942 | De Botelho | 15/209.1 X |
| 3,048,938 | 8/1962 | Mears | 15/209.1 X |
| 4,154,542 | 5/1979 | Rasmason | 401/7 |
| 4,187,575 | 2/1980 | Collins | 15/222 |
| 4,196,490 | 4/1980 | Jonzon | 15/222 |
| 4,254,530 | 3/1981 | Lambert | 15/118 X |
| 4,343,061 | 8/1982 | Hanazono | 15/244.3 |
| 4,457,640 | 7/1984 | Anderson | 401/7 |
| 4,672,707 | 6/1987 | Johnson | 15/222 |
| 4,932,095 | 6/1990 | Kawase | 15/227 |
| 5,187,830 | 2/1993 | Giallourakis | 15/209.1 X |
| 5,361,445 | 11/1994 | Giallourakis | 15/118 |
| 5,504,963 | 4/1996 | Bynum et al. | 15/222 |
| 5,545,456 | 8/1996 | Suida | 428/76 |

FOREIGN PATENT DOCUMENTS

| | | | |
|---|---|---|---|
| 134971 | 10/1933 | Australia | 15/244.4 |
| 35607 | 12/1905 | Switzerland | 15/222 |
| 51922 | 6/1911 | Switzerland | 15/244.3 |
| 25949 | 8/1906 | United Kingdom | 601/136 |

*Primary Examiner*—Mark Spisich
*Attorney, Agent, or Firm*—Virginia H. Meyer, Esq.

[57] ABSTRACT

The present invention provides a new body washing and scrubbing device. According to the invention, the body washing and scrubbing device comprises a pliable outer cover having a first washing surface and a second more abrasive washing surface and an inner malleable core comprised of small bead-like or ovoid objects suitable for exposure to water and/or cleaning agents. This overall configuration achieves a novel body washing and scrubbing device that provides a better grip for the user, as well as an easy and comfortable fit within the user's hand. The overall shape of the present invention may also be configured to resemble animals, such as dogs, ducks, and the like, or objects such as footballs and baseballs.

14 Claims, 2 Drawing Sheets

HAND-HELD BODY WASHING AND SCRUBBING DEVICE

BACKGROUND OF THE INVENTION

1. Field of the Invention

The present invention relates to a small hand-held body washing and scrubbing device.

2. Description of the Prior Art

Many body washing and scrubbing devices are known in the prior art. An example of such a prior art washing device is a terry cloth face washing puff as disclosed in U.S. Pat. No. 4,932,095 issued to Yuichi Kawase. The prior art also includes shower mitts having pouches that hold a bar of soap, such as that disclosed in U.S. Pat. No. 1,154,542 issued to Arthur Rasmason. Other prior art washing devices include loofah scrubbing sponges and the like.

While the body washing and scrubbing devices of the prior art fulfill their respective objectives and requirements, the prior art devices do not disclose or suggest a body washing and scrubbing device comprising a pliable outer cover including a first washing surface and a second more abrasive washing surface and an inner malleable core comprised of small bead-like or ovoid objects suitable for exposure to water and/or cleaning agents. This configuration provides a body washing and scrubbing device that easily adapts to the user's hand for enhanced gripping action. In this respect, the body washing and scrubbing device according to the present invention represents a substantial improvement over the concepts and designs of the prior art, and in doing so provides a novel hand body washing and scrubbing device primarily ergonomically developed for the purpose of easily adapting to the hand of a user. Therefore, it can be appreciated that a need exists for a new body washing and scrubbing device that is inexpensive to manufacture and has a two-textured scrubbing/washing surface and an inner malleable core to easily adapt to the hand of the user providing an enhanced cleaning effect. In this regard, the present invention substantially fulfills this need.

SUMMARY OF THE INVENTION

The present invention provides a new body washing and scrubbing device. According to the invention, the body washing and scrubbing device comprises a pliable outer cover having a first washing surface and a second more abrasive washing surface and an inner malleable core comprised of small bead-like or ovoid objects suitable for exposure to water and/or cleaning agents. According to the invention, the pliable outer cover is configured to have an inner pocket for the placement of the malleable inner core. This overall configuration achieves a novel body washing and scrubbing device that provides a better grip for the user, as well as an easy and comfortable fit within the user's hand. The overall shape of the present invention may also be configured to resemble fanciful animals, such as dogs, ducks, penguins and the like, or objects such as cars, boats, trains, trucks, footballs, baseballs, soccer balls, buildings, planes, buses, helmets, and the like.

The pliable outer cover of the device is configured to provide the overall shape of the device and to create an inner pocket to hold the inner malleable core. The pliable outer cover generally includes a first washing surface and a more abrasive second washing surface. In preferred embodiments, the first washing surface is joined to the second washing surface along their common edges. Suitable methods include knitting, sewing, or stitching. The first washing surface is made from any suitably flexible material such as terry cloth, Turkish bath towel, nylon, or cotton. The second washing surface is more abrasive than the first washing surface and is formed to provide a scrubbing, massaging, and/or scratching action for the washing device. The second washing surface is made of any suitably flexible material having an effective yet comfortable degree of porosity, coarseness, and abrasiveness. Further, the materials may be woven such that the fabric has a coarse grouping of small loops that provide an enhanced scrubbing surface. Suitable materials for the second washing surface include woven sisal, hemp, loofah, nylon, sponge (natural and synthetic), brush, and the like.

In addition to the outer cover, the present invention includes a malleable inner core comprised of small bead-like or ovoid objects that are suitable for exposure to water and cleaning agents. (As used herein, "suitable for exposure to water and cleaning agents" refers to materials that do not substantially degrade, dissolve, or otherwise breakdown when exposed to water and/or cleaning agents such as soap, shampoo, and the like.) The inner malleable core allows the user to manipulate and more easily grab the present scrubbing device. The small bead-like or ovoid objects are made from any suitably water resistant material such as polyethylene, polypropylene, polyvinyl chloride, polyurethane, "Teflon", sand, polyester, ground up formed loofah, and the like. Further, the inner malleable core may include a bead pouch formed to enclose the bead-like or ovoid objects. In one preferred embodiment, the bead pouch comprises nylon mesh.

Still further, buoyant objects, such as air-filled plastic pouches or "Styrofoam " pieces, may be inserted into the inner pocket or into the bead pouch of the inner malleable core to provide a scrubbing device that floats in water. The inner malleable core may also be filled with other buoyant objects such as small "Styrofoam " balls to help the scrubbing device of the present invention to float.

The exact dimensions and shape of the body washing and scrubbing device of the present invention may vary depending upon the age and hand size of the target user. In embodiments targeted at young children, the overall shape of the device may be configured to take on arbitrary, yet amusing shapes, such as dogs, cats, cows, sheep, geese, fish, whales, elephants, starfish, lobsters, crabs, dinosaurs, dolphins, sharks, buffaloes, pigs, chickens, turtles, rabbits, penguins, ducks, swans, manatees, monkeys, apes, platypuses, birds, seals, otters, mongooses, opossum, racoons, chipmunks, squirrels, lizards, snakes, hippos, frogs, alligators, crocodiles, lions, tigers, bears, and the like. For example, one preferred embodiment features a scrubbing device having panels configured to provide an overall duck shape where the belly panel of the duck-shaped device is made of an abrasive scrubbing surface and the remaining panels are made of a terry cloth material.

The more important features of the invention have thus been outlined, rather broadly, so that the detailed description thereof that follows may be better understood, and in order that the present contribution to the art may be better appreciated. Additional features of the invention will be described below.

In this respect, before explaining preferred embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

OBJECTS OF THE INVENTION

It is an object of the present invention to provide a body washing and scrubbing device that adapts to and fits comfortably in the human hand for enhanced and comfortable gripping and cleaning.

It is another object of the invention to provide a body washing and scrubbing device that will easily adapt to the user's hand.

It is yet another object of the invention to provide a body washing and scrubbing device that provides fun and amusement to children and adults.

Corollary objects of the invention are that this body washing and scrubbing device be lightweight, simple in use, environmentally safe and of low manufacturing cost.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF A FIRST PREFERRED EMBODIMENT

Figure 1:
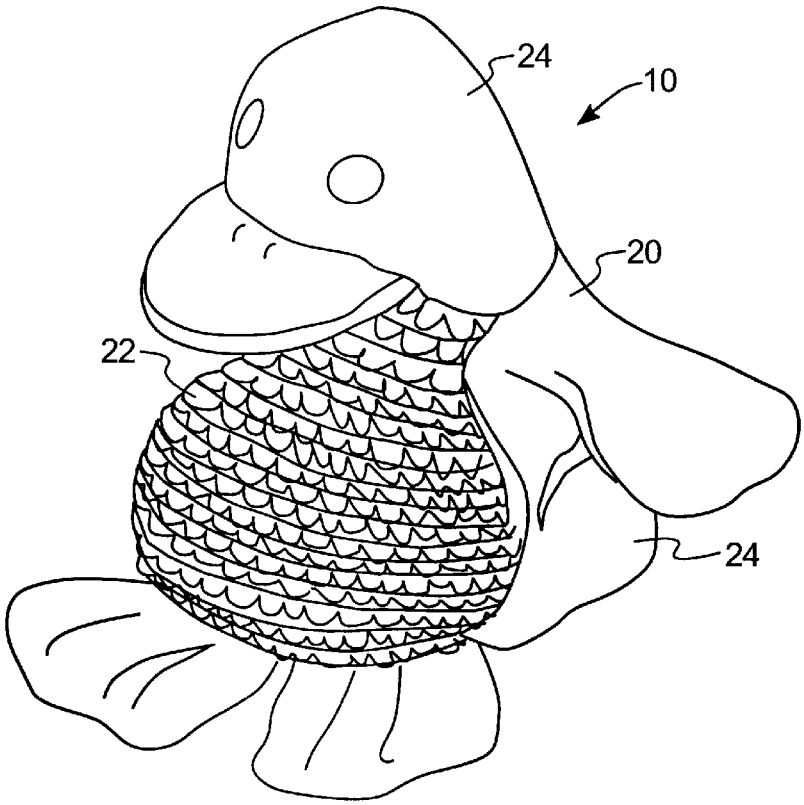
FIG. 1 is a perspective view of a first preferred embodiment constructed in accordance with the principles of the present invention.
Figure 2:
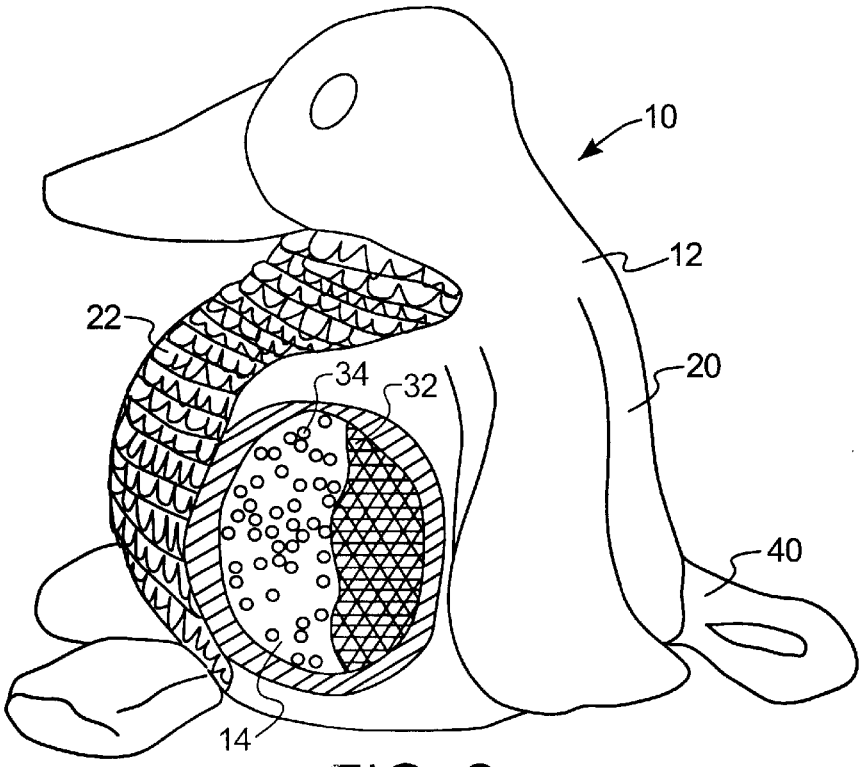
FIG. 2 is a sectional view of the inner core of the first preferred embodiment of the present invention.

With reference now to the drawings, and in particular, to FIGS. 1–2 thereof, a first preferred embodiment of the new body washing and scrubbing device embodying the principles and concepts of the present invention and generally designated by the reference number 10 will be described.

Specifically, it will be noted in the various Figures that the invention relates to a body washing and scrubbing device that a user squeezes and grips in the hand. In its broadest context, the invention comprises a hand-sized device having a pliable outer cover with a first washing surface and a second, more abrasive washing surface, and a malleable inner core. Such components are individually configured and correlated with respect to each other so as to attain the desired objectives.

More specifically, in the first preferred embodiment the present invention is a device 10, as shown in FIGS. 1–2. System 10 comprises an outer cover 12, and an inner core 14. The outer cover 12 comprises first washing cover 20 and a second scrubbing cover 22. First cover 20 includes panels 24 that are configured such that the device takes on various shapes. Panels 24 of first cover 20 are made out of terry cloth. The second cover 22 is made of a woven sisal fabric having a coarse array of loops that provide an enhanced scrubbing action. In the first preferred embodiment, first and second covers 20 and 22 are configured such that device 10 has an overall fanciful duck-like shape. In this embodiment, second cover 22 and panels 24 of first cover 20 are joined along their edges by conventional stitching methods to form a pocket receiving the inner core 14.

Next, provided in device 10 is the inner core 14. Inner core 14 comprises small spherical or ovoid objects 34, such as small plastic pellets surrounded by a bead pouch 32 comprised of nylon mesh. In the first preferred embodiment, the inner core material 34 comprises small polyethylene pellets. The inner core material 34 fills the pocket provided first and second covers 20 and 22 to give the device 10 its overall shape and malleable characteristics. Other embodiments may be constructed without the use of bead pouch 32. Alternatively, but not shown, the device 10 may also include an air-filled pouch within the pocket formed by the outer cover to provide enough buoyancy such that the scrubbing device floats in water.

Device 10 may also include a finger loop 40 attached to the device by any suitable means. In this embodiment, finger loop 40 comprises a terry cloth material that is attached at the stitching that joins together the various panels 24 of first cover 20.

In actual use, the user holds body washing and scrubbing device 10 in his or her hand. As shown in FIG. 1, the device provides the user with a softer terry cloth surface suitable for washing and a second, more abrasive surface that is adapted for a scrubbing and/or massaging action. Further, the inner malleable core allows the device to adapt to the user's hand for a more comfortable grip.

Figure 3:
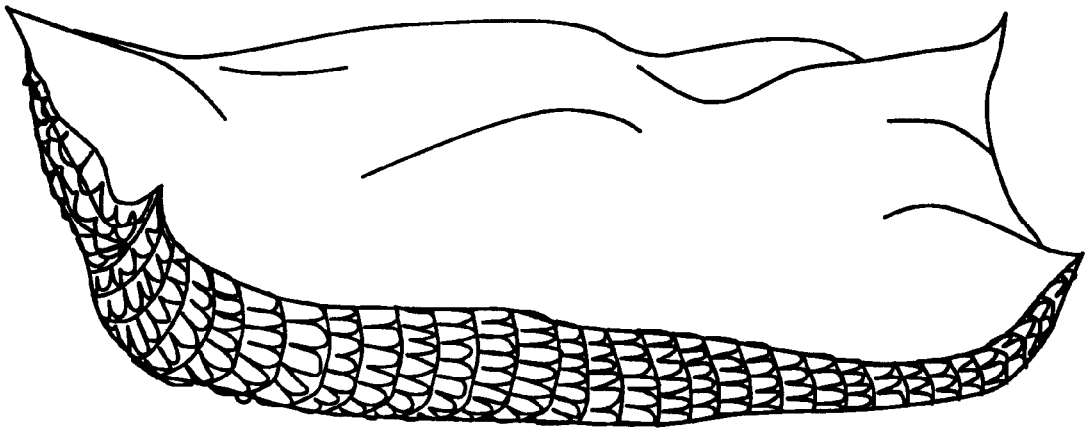
FIG. 3 is a perspective view of the second preferred embodiment of the present invention.

In addition, FIG. 3 shows a second preferred embodiment of the present invention having a simpler, pillow-like shape. One panel of the pillow comprises the more abrasive surface. Otherwise, the construction and use of the second preferred embodiment is substantially the same as the first preferred embodiment.

SUMMARY

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described. Accordingly, all suitable modifications and equivalents which may be resorted to fall within the scope of the invention.

What is claimed as being new and desired to be protected by Letters Patent of the United States is as follows:

1. A body washing and scrubbing device comprising:

a pliable outer cover;

wherein said pliable outer cover includes a first washing surface and a second washing surface;

wherein said second washing surface is more abrasive than said first washing surface;

wherein said pliable outer cover is configured to have an inner pocket; and, an inner malleable core placed within said pocket;

wherein said inner malleable core is comprised of plastic objects suitable for exposure to water and/or cleaning agents;

said plastic objects selected from the group consisting of beas and ovoid objects;

wherein said inner malleable core further includes a pouch surrounding and enclosing said plastic objects.

2. The device according to claim 1 wherein said plastic objects are comprised of polyethylene.

3. The device according to claim 1 wherein said plastic objects are made of a material from the group consisting of: polyethylene, polypropylene, polyvinyl chloride, polyurethane, and polyester.

4. The device of claim 1 wherein said pouch comprises a nylon mesh.

5. The device according to claim 1 wherein said first washing surface comprises terry cloth and said second washing surface comprises a woven sisal fabric.

6. The device according to claim 1 wherein said pliable outer cover comprises a first washing surface of terry cloth and a second washing surface of woven sisal fabric that are joined along their common edges.

7. The device according to claim 1 wherein said second washing surface comprises a woven fabric having a coarse grouping of small loops.

8. The device according to claim 1 wherein said first washing surface is made from material selected from the group consisting of: terry cloth, Turkish bath towel, nylon, and cotton.

9. The device according to claim 1 wherein said second washing surface is made from material selected from the group consisting of: sisal, hemp, loofah, nylon, sponge (natural and synthetic), and brush.

10. The device according to claim 1 further including a finger loop attached thereto.

11. The device according to claim 1 wherein said pliable outer cover is configured to have an overall shape resembling a duck.

12. The device according to claim 1 wherein said pliable outer cover is configured to have an overall shape resembling an animal.

13. The device according to claim 1 wherein said pliable outer cover is configured to have an overall shape resembling an inanimate object.

14. A body washing and scrubbing device comprising:

a pliable outer cover;

wherein said pliable outer cover comprises a first cover surface of terry cloth and a second cover surface of woven sisal fabric that are joined along their common edges;

wherein said second cover surface is more abrasive than said first cover surface;

wherein said pliable outer cover is configured to have an inner pocket; and an inner malleable core within said inner pocket comprised of a pouch surrounding polyethylene pellets;

and further wherein said pliable outer cover is configured to resemble an animal.

* * * * *

UNITED STATES PATENT AND TRADEMARK OFFICE

CERTIFICATE OF CORRECTION

PATENT NO. : 5,915,434

DATED : June 29, 1999

INVENTOR(S) : Mark Reinle Juarez

It is certified that error appears in the above-indentified patent and that said Letters Patent is hereby corrected as shown below:

In Column 5, line 16, please delete "beas" before "and ovoid objects" and insert therefor -- beads --.

Signed and Sealed this

Ninth Day of November, 1999

*Attest:*

Q. TODD DICKINSON

*Attesting Officer*

*Acting Commissioner of Patents and Trademarks*